US009982376B2

(12) United States Patent
Iizuka et al.

(10) Patent No.: US 9,982,376 B2
(45) Date of Patent: May 29, 2018

(54) BOBBIN HOLDER

(71) Applicant: JANOME SEWING MACHINE Co., Ltd., Hachioji-shi, Tokyo (JP)

(72) Inventors: Yosuke Iizuka, Hachioji (JP); Koji Maeda, Hachioji (JP); Satoshi Maruo, Hachioji (JP)

(73) Assignee: JANOME SEWING MACHINE CO., LTD., Hachioji-Shi, Tokyo (JP)

( * ) Notice: Subject to any disclaimer, the term of this patent is extended or adjusted under 35 U.S.C. 154(b) by 15 days.

(21) Appl. No.: 15/215,480

(22) Filed: Jul. 20, 2016

(65) Prior Publication Data

US 2017/0022644 A1 Jan. 26, 2017

(30) Foreign Application Priority Data

Jul. 24, 2015 (JP) ..... 2015-147248

(51) Int. Cl.

*D05B 65/02* (2006.01)
*D01H 1/18* (2006.01)
*D05B 57/26* (2006.01)

(52) U.S. Cl.

CPC ..... *D05B 65/02* (2013.01); *D01H 1/183* (2013.01); *D05B 57/26* (2013.01)

(58) Field of Classification Search

CPC ..... D05B 65/02; D05B 57/26; D05B 57/265
USPC ..... 112/231
See application file for complete search history.

(56) References Cited

U.S. PATENT DOCUMENTS 1,255,183 A * 2/1918 Leathem ..... D05B 57/14 112/231
3,087,447 A * 4/1963 Hermann ..... D05B 57/26 112/231
3,530,811 A * 9/1970 Dolney ..... D05B 57/14 112/229
5,960,728 A * 10/1999 Hirose ..... D05B 57/14 112/231
6,776,111 B2 * 8/2004 Lee ..... D05B 57/26 112/231
7,926,307 B1 * 4/2011 Williams ..... D04B 1/02 66/194

(Continued)

FOREIGN PATENT DOCUMENTS

JP 2002-066184 A 3/2002
JP 2007-252414 A 10/2007

*Primary Examiner* — Danny Worrell
(74) *Attorney, Agent, or Firm* — McGinn IP Law Group, PLLC.

(57) ABSTRACT

A bobbin holder that grasps a holder body and a flange of a bobbin that winds a thread n around the holder body, the holder including: an opening formed in an upper surface of the holder body; a thread holding portion that holds a thread n and is arranged in the opening so as to protrude from a center of the holder body toward an outer circumference of the holder body; and a cutting blade that cuts the thread held by the thread holding portion, the blade being disposed in one of regions inside the opening that is partitioned by the thread holding portion, wherein the cutting blade is disposed on a thread path of the thread n being pulled after the thread n, which is wound around the bobbin grasped by a grasping portion and is pulled from the other region inside the partitioned opening, is held by the thread holding portion.

10 Claims, 4 Drawing Sheets

(56) References Cited

U.S. PATENT DOCUMENTS

| | | | | |
|---|---|---|---|---|
| 9,032,553 | B2 * | 5/2015 | Bevier | A63B 71/141 2/161.3 |
| 9,359,703 | B2 * | 6/2016 | Takagi | D05B 3/00 |
| 2014/0346264 | A1 * | 11/2014 | Yokoyama | B65H 75/28 242/118 |
| 2017/0022644 | A1 * | 1/2017 | Iizuka | D01H 1/183 |

* cited by examiner

VIEW ALONG ARROW X1-X1

CROSS-SECTIONAL VIEW ALONG ARROW X2-X2

CROSS-SECTIONAL VIEW ALONG ARROW X3-X3

CROSS-SECTIONAL VIEW ALONG ARROW X3-X3

CROSS-SECTIONAL VIEW ALONG ARROW X3-X3

ENLARGED VIEW ALONG ARROW X4-X4

Fig.4A
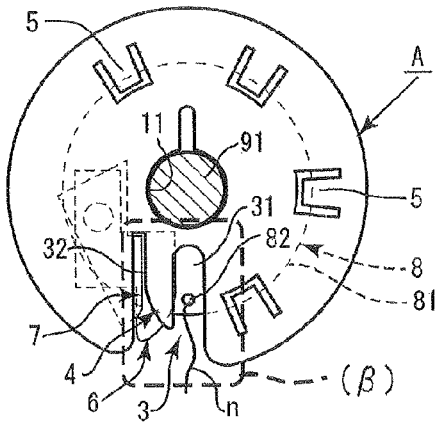
ENLARGED VIEW OF (β)-PART
HOLDER ATTACHMENT CYCLE
VIEW ALONG ARROW X5-X5
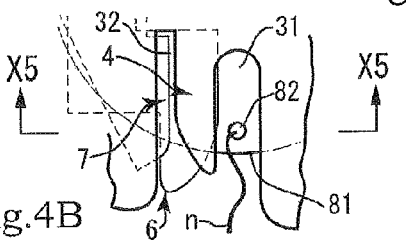
Fig.4B
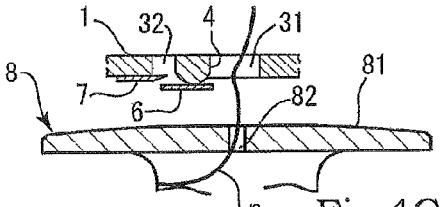
Fig.4C
Fig.4D
LOWER THREAD HOLDING CYCLE
VIEW ALONG ARROW X6-X6
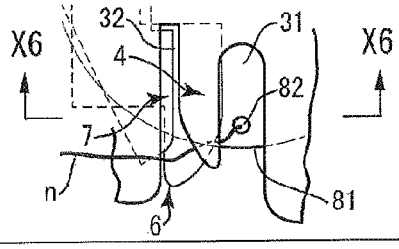
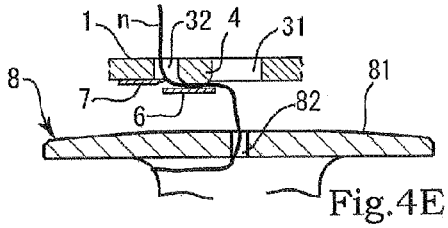
Fig.4E
Fig.4F
LOWER THREAD CUTTING CYCLE
VIEW ALONG ARROW X7-X7
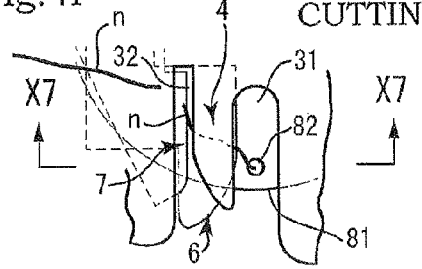
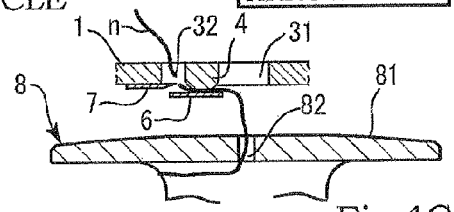
Fig.4G

BOBBIN HOLDER

BACKGROUND OF THE INVENTION

1. Field of the Invention

The present invention relates to a bobbin holder of a sewing machine, capable of fixing a distal end of a lower thread extending out from a bobbin dedicated for the lower thread and cutting an excess portion of the lower thread in an operation of winding the lower thread around the bobbin using a rotation mechanism.

2. Description of the Related Art

In the prior art, a bobbin which winds a lower thread for a sewing machine around itself and is attached to a sewing machine shuttle is subjected to a process in which a predetermined lower thread is unspooled from a spool and wound around the bobbin. Here, a thread hooking hole is formed in a flange of the bobbin, a distal end of the lower thread is passed through the thread hooking hole from a lower side of the flange, the bobbin is rotated by a motor with the distal end being held by the fingertips of an operator, etc., and the lower thread is unspooled from the spool and wound around the bobbin.

In general, when an operation of spooling a lower thread around the bobbin having the above-mentioned configuration is performed, the bobbin is attached to a lower thread winding shaft provided in a sewing machine body. When the bobbin rotates, it is necessary to perform the spooling until a winding start portion is stabilized, while holding a lower thread projecting from the thread hooking hole with the fingertips, and the finger is exposed to danger when holding the thread in this proximity.

Further, the distal end of the lower thread projecting from the thread hooking hole of the bobbin may be caught at the periphery of the thread hooking hole if too long, and therefore an excess portion of the lower thread needs to be cut. An example of such a lower thread spooling device of a bobbin is disclosed in Japanese Patent Application Publication No. 2002-66184 and Japanese Patent Application Publication No. 2007-252414, which are representative examples in the art.

SUMMARY OF THE INVENTION

In Japanese Patent Application Publication No. 2002-66184 and Japanese Patent Application Publication No. 2007-252414, a holding shaft and a thread spooling shaft for attaching a bobbin are provided in a sewing machine, and the bobbin is attached to these shafts. In the inventions disclosed in these patent documents, it is necessary to wind the lower thread around the bobbin a number of times. Further, an excess portion of the lower thread extending out from the bobbin needs to be cut by scissors. Moreover, even when such preparations are made, the lower thread may detach from the bobbin when rotating the bobbin, and the thread may not be wound therearound satisfactorily.

Under these circumstances, an object of (a problem to be solved by) the present invention is to provide a bobbin holder having a lower thread cutting tool capable of winding a lower thread around a bobbin dedicated for the lower thread using a rotation mechanism of a sewing machine and easily cutting an excess portion of the lower thread extending out from the bobbin and a holder capable of holding the cut thread in a cut state.

As a result of intensive studies to solve the above problems, the present inventors solved the problems by providing, as a first embodiment of the present invention, a bobbin holder that grasps a holder body and a flange of a bobbin that winds a thread around the holder body, the holder including: an opening formed in an upper surface of the holder body; a thread holding portion that holds a thread and is arranged in the opening so as to protrude from a center of the holder body toward an outer circumference of the holder body; and a cutting blade that cuts the thread held by the thread holding portion, the blade being disposed in one of regions inside the opening that is partitioned by the thread holding portion, wherein the cutting blade is disposed on a thread path of the thread being pulled after the thread, which is wound around the bobbin grasped by a grasping portion and is pulled from the other region inside the partitioned opening, is held by the thread holding portion.

A second embodiment of the present invention solves the problems by the bobbin holder according to the first embodiment, in which a thread holding plate which makes contact with a lower surface of the thread holding portion and is formed of an elastic thin plate is provided. A third embodiment of the present invention solves the problems by the bobbin holder according to the first or second embodiment, in which a side of the thread holding portion facing the cutting blade has an arc-shaped ridge that is contiguous from a distal end of the thread holding portion, the thread holding plate has an arc-shaped ridge that faces the arc-shaped ridge of the thread holding portion and is contiguous from a distal end of the thread holding plate, and the arc-shaped ridge of the thread holding portion and the arc-shaped ridge of the thread holding plate are disposed to cross each other so as to guide the held thread.

A fourth embodiment of the present invention solves the problems by the bobbin holder according to the first or second embodiment, in which the thread holding plate is configured to cover a side of the opening in which the cutting blade is provided.

A fifth embodiment of the present invention solves the problems by the bobbin holder according to the first or second embodiment, in which a plurality of grasping portions that grasps the flange of the bobbin is formed on a rear surface side of the upper surface of the holder body. A sixth embodiment of the present invention solves the problems by the bobbin holder according to the first or second embodiment, in which the thread holding plate is configured as an elastic plate-shaped piece, and an inclined edge that is bent downward is formed on an outer circumference of the plate-shaped piece.

According to the present invention, in an operation of winding a lower thread around a bobbin dedicated for the lower thread using a rotation mechanism of a sewing machine, it is possible to put the holder of the present invention on the upper surface of the bobbin, align the position of a region on one side of the opening partitioned by the thread holding portion (the lower thread extraction region), formed in the holder, with the position of the thread hooking hole of the flange of the bobbin, and hold and fix the distal end of the lower thread protruding from the upper surface of the flange of the bobbin through the thread hooking hole using holding means (the thread holding portion). Moreover, by passing the lower thread through the other region of the opening partitioned by the thread holding portion (the lower thread cutting region), an excess portion of the lower thread can be cut by the cutting blade provided in this region.

BRIEF DESCRIPTION OF THE DRAWINGS

FIG. 4A is a plan view illustrating a state in which the holder of the present invention is attached to a bobbin attached to a lower thread winding shaft of a sewing machine, FIG. 4B is an enlarged view of (β)-part in FIG. 4A, illustrating a state in which a lower thread protruding from a thread hooking hole of a bobbin is guided to a lower thread extraction region of an opening, FIG. 4C is a cross-sectional view along arrow X5-X5 in FIG. 4B, FIG. 4D is an enlarged view of (β)-part in FIG. 4A, illustrating a state in which a lower thread protruding from a thread hooking hole of a bobbin is pinched by a thread holding portion and a thread holding plate, FIG. 4E is a cross-sectional view along arrow X6-X6 in FIG. 4D, FIG. 4F is an enlarged view of (β)-part in FIG. 4A, illustrating a state in which a lower thread protruding from a thread hooking hole of a bobbin is guided to a lower thread cutting region and cut by a cutting blade, and FIG. 4G is a cross-sectional view along arrow X7-X7 in FIG. 4E.

DESCRIPTION OF THE PREFERRED EMBODIMENTS

Figure 1A:
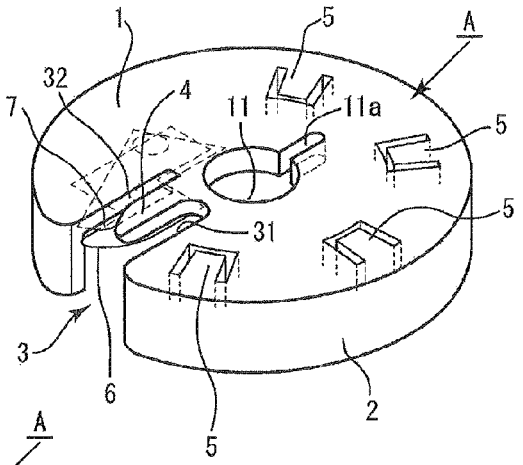
FIG. 1A is a perspective view of a holder of the present invention.

Hereinafter, an embodiment of the present invention will be described with reference to the drawings. As illustrated in FIGS. 1A to 1D, a holder of the present invention is used in a state of being directly attached to a bobbin 8 which is attached to a lower thread winding shaft 91 of a sewing machine 9. The holder includes a holder body A, a thread holding plate 6, and a cutting blade 7 (see FIGS. 1A to 1D). Further, the holder body A includes, and is constituted by, an upper surface portion 1, a side surface portion 2, an opening 3, and a thread holding portion 4. The holder body A is formed of a synthetic resin, metal, or the like.

The upper surface portion 1 is formed in an approximately disk form. The side surface portion 2 is a portion formed in an approximately cylindrical form so as to extend downward from an outer circumferential edge of the upper surface portion 1 (see FIG. 1A). An attachment hole 11 through which the lower thread winding shaft 91 of the sewing machine 9 passes is formed in a radial center of the upper surface portion 1. A stripe-shaped locking hole 11*a* in which a fixing screw of the lower thread winding shaft 91 is inserted is formed in the attachment hole 11.

Figure 1B:
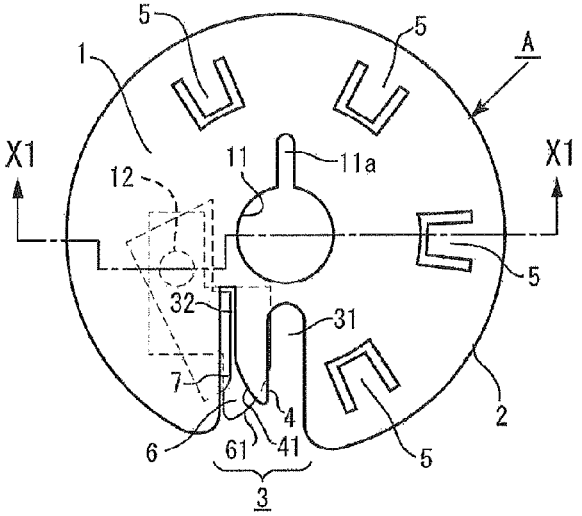
FIG. 1B is a plan view of the holder of the present invention.
Figure 1C:
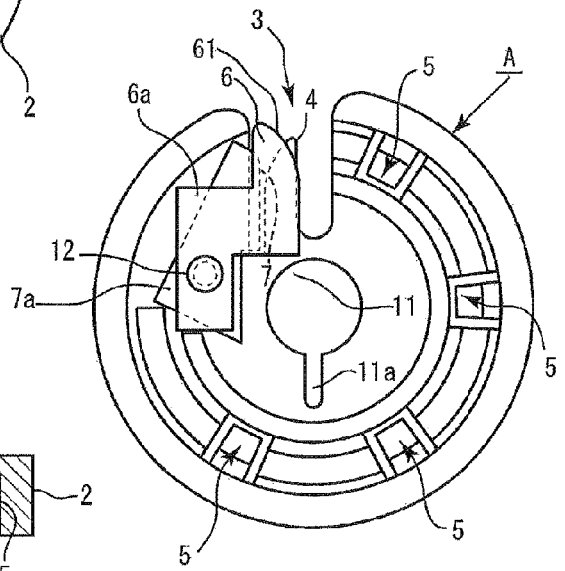
FIG. 1C is a view when seen from a lower surface of the holder of the present invention.
Figure 1D:
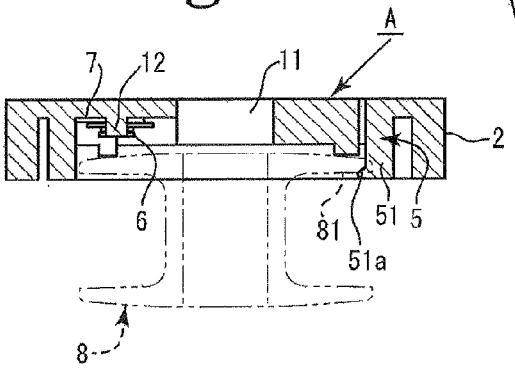
FIG. 1D is a cross-sectional view along arrow X1-X1 in FIG. 1C.

The opening 3 is formed in the upper surface portion 1 (see FIGS. 1A, 1B, and 1C). Specifically, the opening 3 is formed in a hollow form extending toward the radial central portion in which the attachment hole 11 is formed, and the inner end of the opening 3 reaches up to a position near the attachment hole 11 (see FIG. 1A).

Figure 2A:
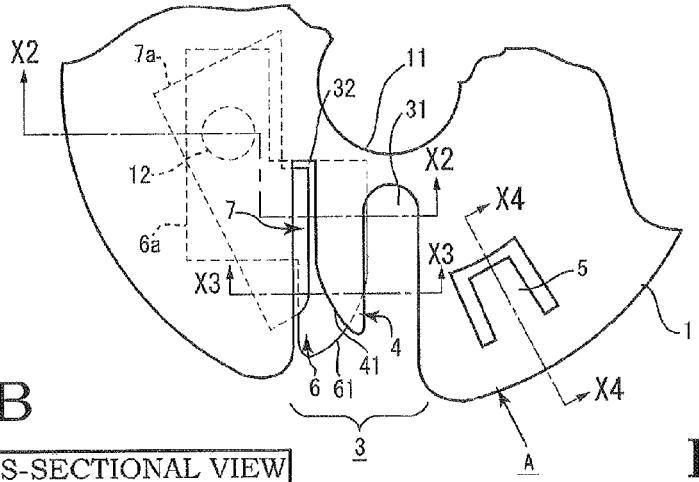
FIG. 2A is an enlarged view of an opening of the present invention.

The thread holding portion 4 is formed so as to extend from a portion on the inner side of the opening 3 located closer to the radial center toward the outer circumference of the upper surface portion 1 (see FIGS. 1A and 1B and FIG. 2A). The distal end of the thread holding portion 4 is disposed inside the opening 3 and does not protrude outward from the outer circumference of the upper surface portion 1. The opening 3 is divided into two regions by the thread holding portion 4, and one region is referred to as a lower thread extraction region 31 and the other region is referred to as a lower thread cutting region 32 (see FIGS. 1A and 1B and FIG. 2A).

The lower thread extraction region 31 is a portion for guiding the distal end of a lower thread n pulled out from the thread hooking hole 82 of the bobbin 8 to the lower thread cutting region 32 in alignment with the position of the thread hooking hole 82 of the bobbin 8 when the holder of the present invention is attached to a flange 81 of the bobbin 8.

Moreover, the lower thread cutting region 32 is a region in which an excess distal end of the lower thread n pulled out from the lower thread extraction region 31 is inserted and cut. The lower thread extraction region 31 is a relatively large area, the lower thread cutting region 32 is a slit-shaped groove and is narrower than the lower thread extraction region 31.

A guiding distal edge 4*a* of which the portion close to the lower thread cutting region 32 is formed in a circular arc shape is formed at a distal end of the thread holding portion 4 (see FIG. 1B and FIG. 2A). Specifically, the guiding distal edge 4*a* is formed such that the distal end of the thread holding portion 4 has a circular arc shape and the width of the distal end gradually decreases as it advances toward the distal end. This is to make the distal end of the lower thread n pulled out from the lower thread extraction region 31 easily inserted into the lower thread cutting region 32.

The rear surface of the upper surface portion 1 has such a shape that the outer circumference is surrounded by the side surface portion 2. The side surface portion 2 is not open to the opening 3. Grasping portions 5 are formed on the upper surface portion 1. The grasping portions 5 have a function of attaching the bobbin holder of the present invention to the flange 81 of the bobbin 8. As a specific embodiment of the grasping portion 5, a claw 51 having a shape of hanging toward the lower surface side of the upper surface portion 1 is formed, and a claw piece 51*a* is formed at a lower end of the claw 51 so as to extend toward the radial center of the upper surface portion 1 (see FIG. 2F).

Figure 2B:
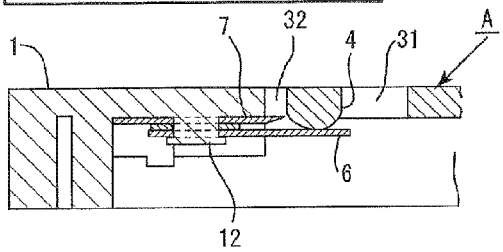
FIG. 2B is a cross-sectional view along arrow X2-X2 in FIG. 2A.
Figure 2C:
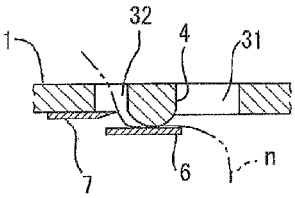
FIG. 2C is a cross-sectional view along arrow X3-X3 in FIG. 2A.
Figure 2D:
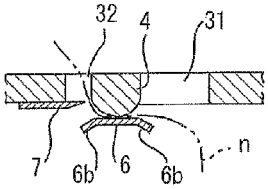
FIG. 2D is a cross-sectional view along arrow X3-X3 in FIG. 2A as another embodiment.
Figure 2E:
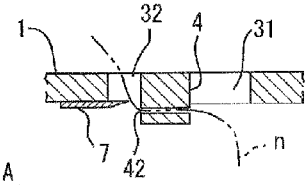
FIG. 2E is a cross-sectional view along arrow X3-X3 in FIG. 2A as still another embodiment.
Figure 2F:
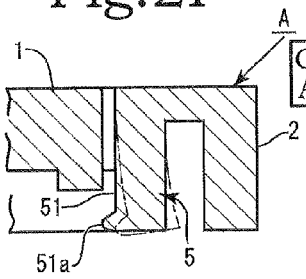
FIG. 2F is an enlarged cross-sectional view along arrow X4-X4 in FIG. 2A.
Figure 3A:
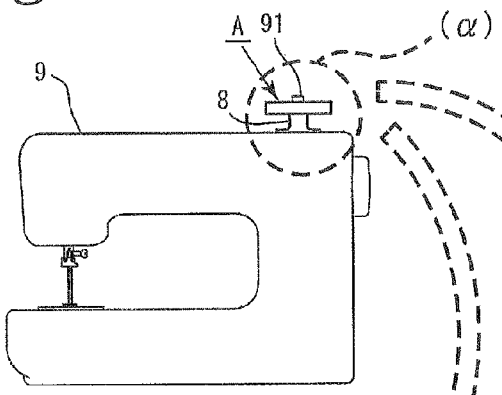
FIG. 3A is a schematic front view illustrating a state in which the holder of the present invention is attached to a bobbin attached to a sewing machine.
Figure 3B:
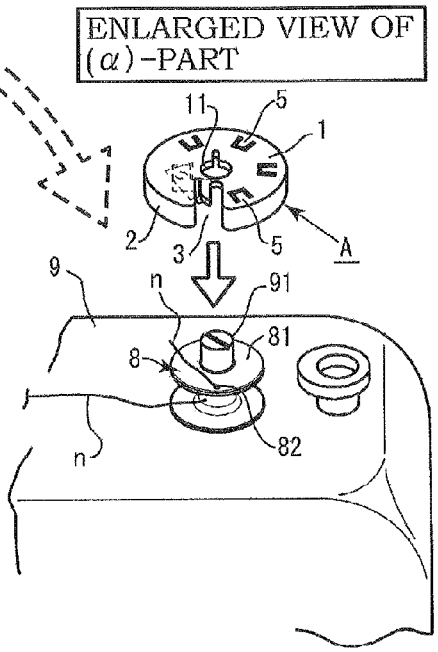
FIG. 3B is a perspective view of (α)-part in FIG. 3A, illustrating the cycle of attaching the holder of the present invention to a bobbin attached to a lower thread winding shaft of the sewing machine.
Figure 3C:
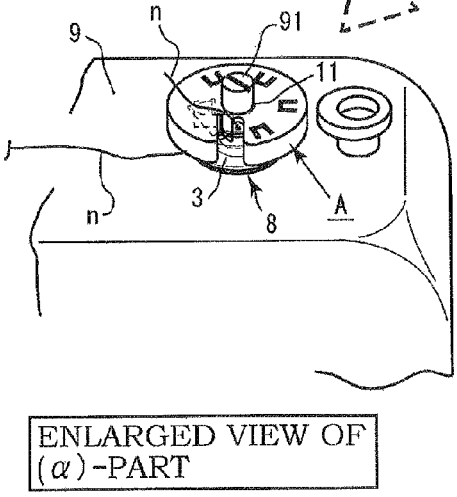
FIG. 3C is a perspective view of (α)-part in FIG. 3A, illustrating a state in which the holder of the present invention is attached to a bobbin attached to a lower thread winding shaft of a sewing machine.
Figure 3D:
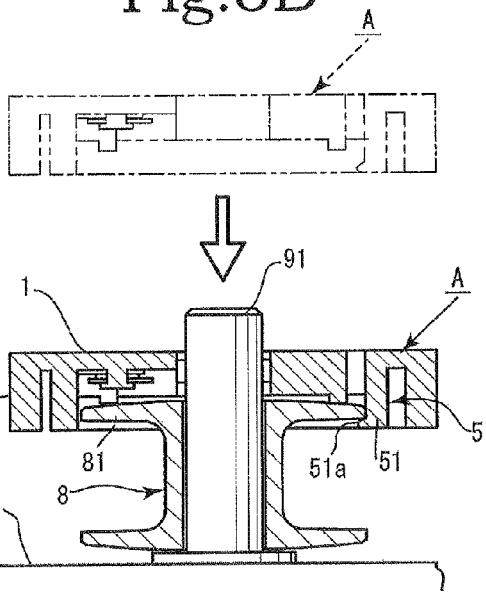
FIG. 3D is a vertical enlarged side view illustrating a state in which the holder of the present invention is attached to a bobbin attached to a lower thread winding shaft of a sewing machine.

The claw 51 has an elastic property and can be deformed when the bobbin is attached (see FIG. 2F). The claws 51 are disposed at a position near the outer circumferential edge of the upper surface portion 1 at an equal interval in the circumferential direction. The claws 51 are not necessarily arranged in a circumferential form but may be arranged approximately in a hemispherical form (see FIGS. 1B and 1C).

The thread holding plate 6 and the cutting blade 7 are provided on a rear surface side of the upper surface portion 1. Moreover, the cutting blade 7 is positioned above the thread holding plate 6 on a thread path and is attached to the rear surface side of the upper surface portion 1. Specifically, the position of the cutting blade 7 may be slightly above the position of the thread holding plate 6.

Moreover, the position of the cutting blade 7 is preferably located above the lower surface of the thread holding portion 4. The thread holding plate 6 and the cutting blade 7 are formed of a piece of a metal plate. Attachment pieces 6*a* and 7*a* are formed on the thread holding plate 6 and the cutting blade 7, respectively, and an attachment through-hole is formed in each attachment piece. Moreover, the thread holding plate 6 is preferably a thin metal plate having an elastic property.

Moreover, an attachment region is formed on the lower surface side of the upper surface portion 1 of the holder body A, and a protruding portion 12 is formed in the attachment region. The protruding portion 12 passes through the through-holes of the attachment pieces 6*a* and 7*a* and is fixed by means of press-fitting. Moreover, when the holder body A is a synthetic resin, the protruding portion 12 may be fixed by fusing. The thread holding plate 6 pinches and holds the lower thread by making contact with or approaching the lower surface of the thread holding portion 4.

Moreover, the lower surface side of the thread holding portion 4 is formed in a circular arc form in a cross-sectional shape orthogonal to the longitudinal direction of the thread holding portion 4 (see FIGS. 2B to 2D). Due to this, the lower thread n can be easily inserted between the thread holding portion 4 and the thread holding plate 6, and a portion in which the lower thread n is pinched by the thread holding portion 4 and the thread holding plate 6 is not sharp but has a roundness. Thus, it is possible to prevent damage of the lower thread n.

The thread holding plate 6 is formed so as to protrude outward from the lower surface of the thread holding portion 4. That is, the thread holding plate 6 is formed larger than the lower surface of the thread holding portion 4 so as to protrude in a planar direction from the lower surface of the thread holding portion 4. Due to this, the lower thread n projecting from the thread hooking hole 82 of the bobbin 8 can be inserted between the thread holding portion 4 and the thread holding plate 6 and be set in a pinched state.

The thread holding plate 6 is configured so as to cover, from the lower side, the lower thread cutting region 32 on the side of the opening 3 in which the cutting blade 7 is provided. This covering includes a state in which the lower thread cutting region 32 is substantially covered by the thread holding plate 6. With such a configuration, in the lower thread cutting region 32, the lower thread n can be easily guided to the position of the cutting blade 7, and the excess portion of the distal end of the lower thread n can be easily and quickly cut.

Moreover, the thread holding plate 6 may have an inclined edge 6*b* formed an outer circumferential edge of the plate-shaped piece so as to bent downward (see FIG. 2D). The inclined edge 6*b* is an edge that is inclined downward from a portion corresponding to the outer circumference of the lower surface of the thread holding portion 4. With the inclined edge 6*b*, it is possible to facilitate an operation of inserting the lower thread n between the thread holding portion 4 and the thread holding plate 6 and maintaining the lower thread n in the pinched state.

Moreover, a portion of the thread holding portion 4 facing the cutting blade 7 has an arc-shaped ridge 41 that is contiguous from the distal end thereof. The thread holding plate 6 has an arc-shaped ridge 61 that faces the arc-shaped ridge 41 of the thread holding portion 4 and is contiguous from the distal end thereof. The ridges 41 and 61 are lines that form a convex arc-shaped side. The ridge 41 of the thread holding portion 4 and the ridge 61 of the thread holding plate 6 are configured to face each other and are disposed to cross each other at the distal ends of the distal ends of the ridges 41 and 61 (see FIG. 1A and FIGS. 2A to 2F).

With such a configuration, the distal end of the ridge 41 of the thread holding portion 4 and the distal end of the ridge 61 of the thread holding plate 6 form an approximately V-shaped lower thread introduction portion, and the lower thread n can be smoothly guided from the lower thread extraction region 31 to the lower thread cutting region 32 (see FIGS. 4A to 4G).

Further, an embodiment in which the thread holding plate 6 is not provided in the thread holding portion 4 may be present. In this embodiment, a horizontal slit 42 is formed in the thread holding portion 4 (see FIG. 2E). Specifically, the slit 42 is formed so as to extend from the distal end of the thread holding portion 4 to an intermediate portion in the longitudinal direction. The lower thread n is held and fixed to the thread holding portion 4 by being inserted into the slit 42. The gap of the slit 42 is preferably substantially the same as the diameter of the lower thread n or slightly smaller than the diameter of the lower thread n.

Next, the use of the bobbin holder of the present invention will be described with reference to FIGS. 3A to 3D and FIGS. 4A to 4G. First, the lower thread winding shaft 91 is provided in the general sewing machine 9 (see FIG. 3B). The lower thread winding shaft 91 is attached to the bobbin 8. The thread hooking hole 82 is formed in the flange 81 of the bobbin 8. The thread hooking hole 82 is used to guide one end of the lower thread n from the core side of the bobbin 8 to the outside of the flange 81.

The holder of the present invention is put on the flange 81 of the bobbin 8 attached to the lower thread winding shaft 91 of the sewing machine 9. In this case, the holder is grasped by the grasping portion 5 of the holder body A and fixed to the flange 81 (see FIGS. 3A, 3C, and 3D). Here, the position of the lower thread extraction region 31 of the opening 3 of the upper surface portion 1 is aligned with the position of the thread hooking hole 82 of the bobbin 8 and the lower thread n is guided to the lower thread extraction region 31 (see FIGS. 4A to 4C).

Subsequently, the distal end of the lower thread n projecting from the thread hooking hole 82 is moved toward the lower thread cutting region 32 while inserting the same between the thread holding portion 4 and the thread holding plate 6 and the lower thread n is guided to the lower thread cutting region 32 (see FIGS. 4D and 4E). In this process, the lower thread n is pinched between the thread holding portion 4 and the thread holding plate 6, the lower thread n is pressed against the lower surface of the thread holding portion 4 by the thread holding plate 6, and the distal end of the lower thread n is held in this manner (see FIGS. 4D and 4E). In this way, even when the bobbin 8 is rotated at a high speed by the lower thread winding shaft 91, the distal end of the lower thread n protruding from the thread hooking hole 82 and being set on the flange 81 can be prevented from slipping out from the flange 81.

Subsequently, when the distal end of the lower thread n entering into the lower thread cutting region 32 is moved toward the center of the upper surface portion 1, the distal end of the lower thread n makes contact with the cutting blade 7 protruding into the lower thread cutting region 32 and is cut (see FIGS. 4F and 4G). In this way, the excess portion of the lower thread n is cut, and the lower thread n is prevented from coiling around other portions during the spooling operation of the bobbin 8. Moreover, when the spooling of the bobbin 8 ends, the bobbin 8 is removed from the lower thread winding shaft 91, the holder of the present invention is removed from the bobbin 8, and the bobbin 8 is attached to a sewing machine shuttle.

Moreover, when winding of the lower thread n around the bobbin 8 is finished, the lower thread n supplied from a reel (not illustrated) is pinched by the thread holding portion 4 and the thread holding plate 6 provided in the holder and is cut by the cutting blade 7 while maintaining the pinched state, and the bobbin 8 is detached from a spooling device of the sewing machine 9 and be stored with the holder attached to the bobbin 8. In this way, it is possible to prevent the end of the lower thread n of the spooled bobbin 8 from being unspooled and the winding state from being loosened and to store the bobbin 8 while maintaining the spooled state of the bobbin 8.

In the second embodiment, since the thread holding plate which makes contact with the lower surface of the thread holding portion and is formed of an elastic thin plate is provided, an operation of holding and fixing a lower thread can be performed very easily. Moreover, since the cutting blade is positioned above the lower surface of the thread holding portion, the lower thread pinched and fixed between the thread holding portion and the thread holding plate is pulled upward and inevitably makes contact with the cutting blade, and an excess portion of the distal end can be cut.

In the third embodiment, a thread can be easily inserted between the thread holding portion and the thread holding plate of the opening. In the fourth embodiment, since the thread holding plate covers the side of the opening in which the cutting blade is provided, it is possible to hold the thread more tightly.

In the fifth embodiment, since the holder has the grasping portion for fixing the flange of the bobbin, it is possible to rotate the bobbin in a state in which the bobbin holder of the present invention is attached to the flange of the bobbin to perform a lower thread winding operation. Moreover, when the winding of the lower thread around the bobbin is completed, the bobbin holder of the present invention can be easily removed from the flange of the bobbin and can be immediately attached to the sewing machine shuttle.

In the sixth embodiment, since the presser foot is configured as a plate-shaped piece having an elastic property, and an inclined edge that is bent downward is formed on the outer circumferential edge of the plate-shaped piece, it is possible to facilitate an operation of inserting the distal end of the lower thread between the presser foot and the protruding portion.

What is claimed is:

1. A bobbin holder that grasps a holder body and a flange of a bobbin that winds a thread around the holder body; the bobbin holder comprising:

an opening formed in an upper surface of the holder body;

a thread holding portion that holds a thread and is arranged in the opening so as to protrude from a center of the holder body toward an outer circumference of the holder body, the thread holding portion partitioning the opening into a first region and a second region;

a cutting blade that cuts the thread held by the thread holding portion, the cutting blade being disposed in the first region inside the opening that is partitioned by the thread holding portion; and a grasping portion that grasps the flange of the bobbin in which the thread is wound around, wherein the cutting blade is disposed on a thread path of the thread that is held by the thread holding portion, the thread being pulled from the second region inside the opening that is partitioned.

2. The bobbin holder according to claim 1, further comprising:

a thread holding plate which makes contact with a lower surface of the thread holding portion and comprises an elastic plate.

3. The bobbin holder according to claim 1, wherein a side of the thread holding portion facing the cutting blade has an arc-shaped ridge that is contiguous from a distal end of the thread holding portion, wherein the bobbin holder further comprises a thread holding plate which contacts with a lower surface of the thread holding portion, wherein the thread holding plate has an arc-shaped ridge that faces the arc-shaped ridge of the thread holding portion and is contiguous from a distal end of the thread holding plate, and wherein the arc-shaped ridge of the thread holding portion and the arc-shaped ridge of the thread holding plate are disposed to cross each other so as to guide the held thread.

4. The bobbin holder according to claim 1, wherein the bobbin holder further comprises a thread holding plate which contacts with a lower surface of the thread holding portion, and wherein the thread holding plate is configured to cover a side of the opening in which the cutting blade is provided.

5. The bobbin holder according to claim 1, wherein a plurality of grasping portions, each including the grasping portion, is formed on a rear surface side of the upper surface of the holder body, the plurality of grasping portions grasping the flange of the bobbin.

6. The bobbin holder according to claim 1, wherein the bobbin holder further comprises a thread holding plate which contacts with a lower surface of the thread holding portion, and wherein the thread holding plate is configured as an elastic plate-shaped piece, and an inclined edge that is bent downward is formed on an outer circumference of the plate-shaped piece.

7. The bobbin holder according to claim 2, wherein a side of the thread bolding portion facing the cutting blade has an arc-shaped ridge that is contiguous from a distal end of the thread holding portion, wherein the thread holding plate has an arc-shaped ridge that faces the arc-shaped ridge of the thread holding portion and is contiguous from a distal end of the thread holding plate, and wherein the arc-shaped ridge of the thread holding portion and the arc-shaped ridge of the thread holding plate are disposed to cross each other so as to guide the held thread.

8. The bobbin holder according to claim 2, wherein the thread holding plate is configured to cover a side of the opening in which the cutting blade is provided.

9. The bobbin holder according to claim 2, wherein a plurality of grasping portions, each including the grasping portion, is formed on a rear surface side of the upper surface of the holder body, the plurality of grasping portions grasping the flange of the bobbin.

10. The bobbin holder according to claim 2, wherein the thread holding plate is configured as an elastic plate-shaped piece, and an inclined edge that is bent downward is formed on an outer circumference of the plate-shaped piece.

* * * * *